US006859938B1

(12) United States Patent
Niski et al.

(10) Patent No.: US 6,859,938 B1
(45) Date of Patent: Mar. 1, 2005

(54) PROTECTIVE BIB WITH SNUG FITTING FEATURE

(76) Inventors: Brian W. Niski, 540 Alden Way, Roseville, CA (US) 95678; Claudine Niski, 540 Alden Way, Roseville, CA (US) 95678

( * ) Notice: Subject to any disclaimer, the term of this patent is extended or adjusted under 35 U.S.C. 154(b) by 0 days.

(21) Appl. No.: 10/718,873

(22) Filed: Nov. 21, 2003

(51) Int. Cl.[7] ..... A41B 13/10
(52) U.S. Cl. ..... 2/49.1; 2/52
(58) Field of Search ..... 2/49.1, 49.2, 49.3, 2/49.4, 49.5, 52, 48, 50, 51, 468, 91, 129–134, 136, 139, 60, 174, 244, 255, 207, 208; 24/7, 9, 3.4

(56) References Cited

U.S. PATENT DOCUMENTS

| | | | | | |
|---|---|---|---|---|---|
| 115,238 | A | * | 5/1871 | Raiford | 24/9 |
| 383,847 | A | * | 6/1888 | Baker | 2/52 |
| 392,676 | A | * | 11/1888 | Jacoby | 2/52 |
| 502,739 | A | * | 8/1893 | Mock | 24/9 |
| 703,864 | A | * | 7/1902 | Walker | 2/52 |
| 815,998 | A | * | 3/1906 | Wolff | 2/170 |
| 932,487 | A | * | 8/1909 | Melio | 2/208 |
| 1,336,744 | A | * | 4/1920 | Henderson | 24/9 |
| 2,211,184 | A | * | 8/1940 | Varell | 2/174 |
| 2,243,505 | A | * | 5/1941 | Mercer | 2/50 |
| 2,421,195 | A | * | 5/1947 | Goldsmith | 2/48 |
| 2,430,941 | A | * | 11/1947 | Long | 2/49.1 |
| 2,525,115 | A | * | 10/1950 | Britton | 2/49.2 |
| 2,558,414 | A | * | 6/1951 | Blackman | 2/49.4 |
| 2,629,870 | A | * | 2/1953 | Hudson | 2/49.1 |
| 2,637,853 | A | * | 5/1953 | Rochlin et al. | 2/174 |
| 2,655,659 | A | * | 10/1953 | Swearingen | 2/52 |
| 2,675,551 | A | * | 4/1954 | Ser Vaas | 2/52 |
| 2,717,389 | A | * | 9/1955 | Gribble et al. | 2/50 |
| 2,884,638 | A | * | 5/1959 | Ream | 2/48 |
| 2,900,640 | A | * | 8/1959 | Haydu | 2/49.1 |
| 3,042,930 | A | * | 7/1962 | Martinez | 2/48 |
| 4,620,323 | A | | 11/1986 | Tepper | |
| 4,646,365 | A | | 3/1987 | Suprise et al. | |
| 4,706,303 | A | | 11/1987 | Van Gompel et al. | |
| 5,191,681 | A | * | 3/1993 | Lokken | 24/9 |
| 5,621,916 | A | * | 4/1997 | Bell | 2/48 |
| 5,621,921 | A | * | 4/1997 | Outland | 2/207 |
| 5,666,665 | A | | 9/1997 | Morgado | |
| 5,920,909 | A | * | 7/1999 | Ellsworth et al. | 2/171 |
| 6,125,471 | A | | 10/2000 | Gupta et al. | |
| 6,131,197 | A | * | 10/2000 | Wang | 2/50 |
| 6,266,820 | B1 | | 7/2001 | Gupta et al. | |
| 6,363,530 | B1 | | 4/2002 | Lampson et al. | |
| 6,374,411 | B1 | * | 4/2002 | Duhn | 2/49.1 |
| 6,481,016 | B1 | | 11/2002 | Rees | |
| 6,718,554 | B1 | * | 4/2004 | Langston | 2/49.1 |

* cited by examiner

*Primary Examiner*—Amy B. Vanatta
(74) *Attorney, Agent, or Firm*—John P. Costello

(57) ABSTRACT

An inventive bib comprising a hoop made of memory material, a collar for fitting around a wearer's neck and a body portion for protecting the chest of the wearer. The hoop communicates with the collar and both the collar and hoop can be expanded to form a neck opening for placing on a wearer's neck. Upon releasing the expanding force on the hoop, the hoop naturally contracts due to its memory material construction. The contraction of the hoop provides an encircling force upon the collar and the collar thereby encircles the wearer's neck to form a snug fit.

9 Claims, 3 Drawing Sheets

PROTECTIVE BIB WITH SNUG FITTING FEATURE

TECHNICAL FIELD

The present invention pertains to protective garments, such as bibs for infants. More particularly, although not exclusively, the present invention pertains to a protective bib garment which enables a more effective fit around a wearer's neck and which can be placed snugly upon a wearer's neck without the aid of fasteners.

BACKGROUND

Protective garments such as infant bibs are used on most infants and children to protect their bodies and clothing from dribbled and spilled liquids and other food-stuff materials. Many bibs use absorbent materials, such as terrycloth, while others use impermeable materials that repel liquids and food instead of absorbing them. Some bibs are reusable, like clothing, and can be washed in a washing machine while others are made of plastics and can be wiped with a cloth. Others are disposable and are meant for single use.

Various bib configurations have been developed to place and secure the bib to a wearer, such as an infant. While there are many configurations for securing a bib to an infant, they can all be placed into two general categories. The first category includes bibs with two arm-like appendages which wrap around the infant's neck and attach/secure behind the infant's neck using fasteners such as buttons, strings, snaps, tape or hook and loop fasteners sold under the trademark Velcrol®. The second category includes bibs having an opening within the body of the bib so that the bib can slide down over the infant's head. The opening may be a circular hole cut into the bib, or else comprise a cutout employing a neck band to hang the bib around an infant's neck.

The two general bib configurations have two main disadvantages: 1) the first disadvantage relates to their ineffective fit around the neck of a wearer, this ineffective fit allowing excess space for food and "dribble" to run down the chin and neck of the wearer and onto the wearer's clothing; and 2) the second disadvantage relates to the lack of easy placement on a wearer, especially infants.

With regard to the second disadvantage noted above, each of the general bib configurations present special difficulties. Specifically, with regard to bibs using two arm-like appendages, it is difficult to fasten the appendages behind the neck of the wearer, especially if the wearer is an infant. Very young infants, in particular, have very weak necks, and securing these bibs requires the infant to be leaned forward and significantly jostled to secure the bib. Additionally, with regard to bibs that slide over the head, in many cases these bibs must be yanked on, in a strenuous manner, if the infant is to have a reasonable fit around the neck, because infants have disproportionately large heads in comparison to the rest of their body parts.

Therefore, a need exists for a bib which provides a comfortable, yet snug fit around a wearer's neck, and which can be easily placed around a wearer's neck without the use of fasteners.

SUMMARY OF THE INVENTION

The present invention is a bib to be worn around the neck and over the chest to protect against any spilled liquids or food products. In particular, the present invention provides a distinctive embodiment which can be snugly and easily placed onto a wearer.

The inventive bib comprises a snug fitting collar located inside of a flexible hoop, wherein the hoop and associated collar can be flexibly opened to receive the neck of a wearer. The collar has an inner border adjacent the neck opening which may be elasticized to allow the occurrence of a snug, yet comfortable fit. The flexible hoop is made from a memory material that, subsequent to expanding, will naturally contract to its original shape and size. The flexible hoop can be formed in a manner to mold comfortably and approximately to the shoulders of a wearer. In a preferred embodiment, the flexible hoop has overlapping ends, which are forcibly drawn together, thereby exerting an encircling force upon the collar, causing it to close snugly, yet comfortably, around the neck of a wearer. The encircling force of the flexible hoop allows the bib to be placed around the neck of the wearer without the use of fasteners. In use, the bib can be placed on a wearer from the front, or from the side of the neck, depending on the placement of the hoop opening, and any further fastening is unnecessary. This invention thereby obviates the difficulty associated with prior art bibs which required fastening, and the associated jostling of an infant's head while struggling to close the fasteners.

The inventive bib further comprises a body portion which hangs below the collar and hoop portions, thereby protecting the chest of the wearer from spilled liquids and food materials. The inventive bib may be constructed from absorbent materials such as terry cloth or paper as well as non-absorbent materials, such as plastics.

BRIEF DESCRIPTION OF THE DRAWINGS

The invention will be more fully understood by reference to the following drawings which are for illustrative purposes only.

DETAILED DESCRIPTION OF THE PREFERRED EMBODIMENTS

Figure 1:
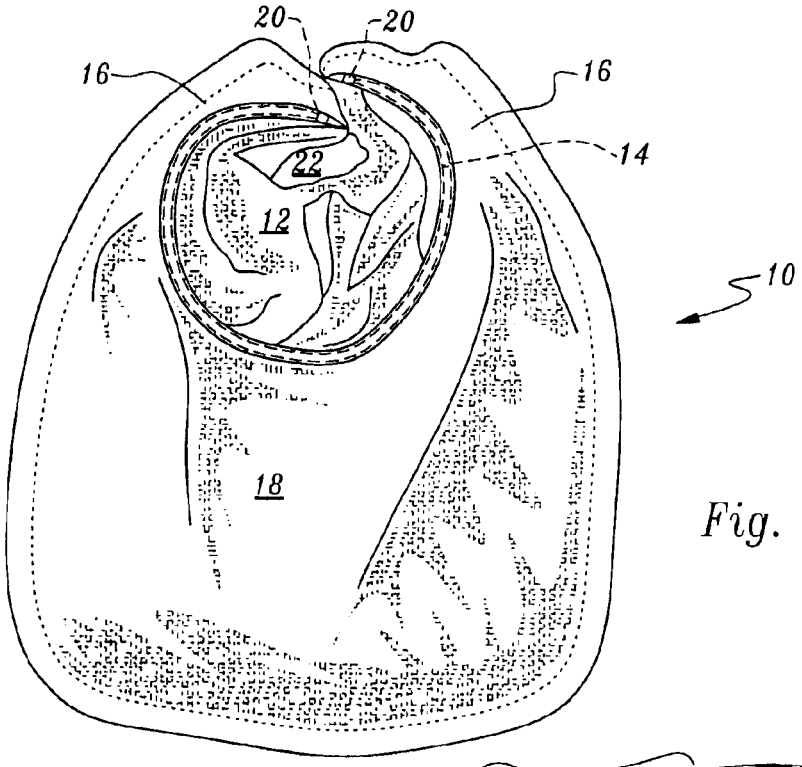
FIG. 1 is an elevated front perspective view of the inventive bib showing the hoop element in phantom.

Referring to FIG. 1, the preferred embodiment of the inventive bib 10 is shown. The bib is comprised of a collar 12, a flexible hoop 14, opposing arms 16 and a body portion 18. The collar, opposing arms and body portion are comprised of materials that are absorbent, nonabsorbent, or a combination of absorbent and non-absorbent materials. Absorbent materials which meet the invention's specifications include terry cloth and absorbent paper compositions. Non-absorbent materials include papers rendered impervious to liquids and various plastics such as polypropylene and polyethylene.

The flexible hoop 14 has ends 20 which can be expanded apart (along with the opposing arms 16) to form an opening 22 for accommodating the neck of a wearer. Hoop 14 provides the inventive bib 10 with structural integrity that is flexibly rigid. The flexible hoop 14 is preferably incorporated into the aforementioned materials by sewing, molding, or other suitable means of incorporation. This incorporation allows the hoop 14 to communicate with the collar 12, opposing arms 16 and body portion 18 in an expanding and contracting fashion. The expanding and contracting qualities of the hoop 14 are possible due to the hoop being comprised of a memory material, which upon being forced into an expanded state, naturally contracts to its original shape and dimensions, upon being relieved of the expanding force. Suitable memory materials include spring steel, metal wire, rubber or various flexible plastics such as polypropylene or polyethylene. If spring steel or metal wire is used it is preferable that they be treated to be rendered resistant to rust and corrosion.

Figure 2A:
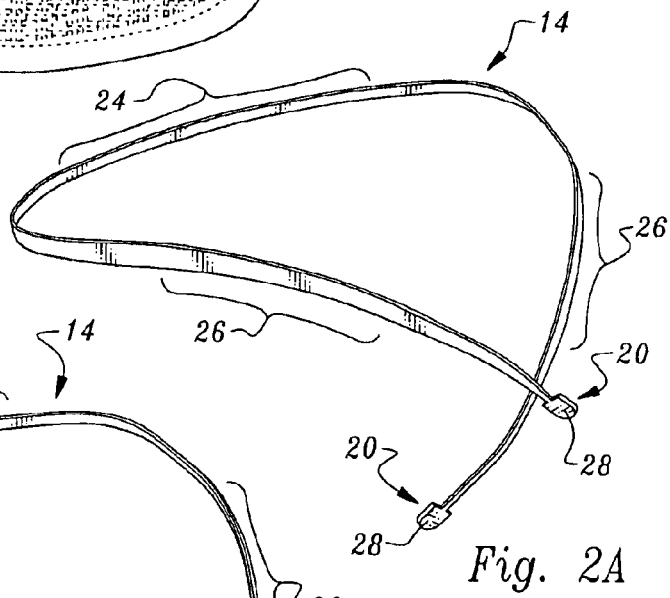
FIG. 2A is a rear side perspective view of the hoop element of the inventive bib shown in its contracted resting state.

Referring now to FIG. 2A, a preferred configuration of hoop 14 is further detailed. Hoop can be formed in any shape which, upon contraction, applies an encircling force to collar 12, however, in the preferred embodiment, as shown here, hoop 14 is formed into a contoured shape which approximates the shape of a wearer's shoulders. Hoop 14 has a preformed curved front section 24 along its horizontal axis, but also has preformed curved side sections 26 which curve rearward of front section along the vertical axis of hoop. The curved side sections 26 are meant to approximate the curved shoulder tops of a wearer. In this way hoop 14 provides the inventive bib 10 with a structural integrity for allowing the bib to hang comfortably over the shoulders of a wearer in a form fitting manner and also provides a proper orientation for the body portion 18 to lay upon the chest of a wearer. Ends 20 of hoop 14 may be capped or blunted 28 so that they do not penetrate the outer material of bib 10. Ends 20 preferably overlap to provide closure of the hoop 14, arms 16 and collar 12 around the back of the wearer's neck as will be further shown herein.

Figure 2B:
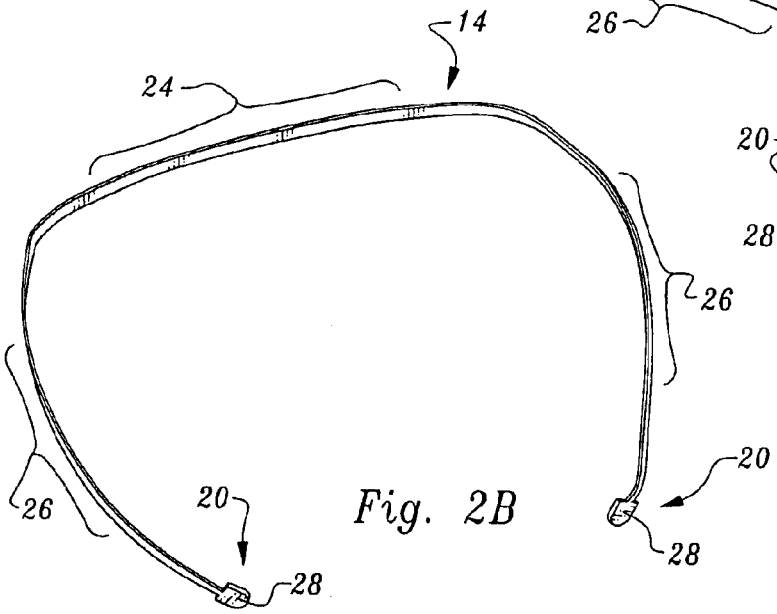
FIG. 2B is a rear side perspective view of the hoop element of the inventive bib shown in its expanded state with expanding force being applied thereto.

Referring to FIG. 2B, the effect of the application of expanding force to hoop 14 is shown. Expanding force can be applied by a user grasping hoop ends 20 directly, or else by indirectly grasping opposing arms 16 and pulling them apart. Upon pulling ends 20 apart and reaching an expanded state, an opening 22 (see FIGS. 1 and 3) is formed in hoop 14. The opening 22 allows a wearer's neck to be inserted within the confines of hoop 14. Collar 12 resides inside of hoop 14, thus simultaneously capturing the wearer's neck snugly within the collar 12. Collar 12 communicates with hoop 14 and expands and contracts in conjunction with hoop. The contraction of hoop 14 back to its resting state as shown in FIG. 2A exerts an encircling force upon collar 12, thereby capturing a wearer's neck in a snug manner. This snug fit helps to prevent liquids and food materials from traveling down a wearer's neck and soiling the wearer's clothes.

Figure 3:
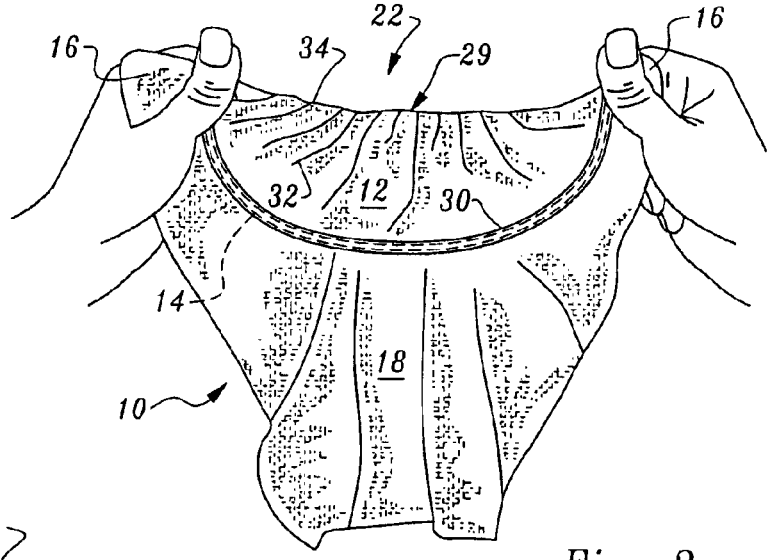
FIG. 3 is a closeup perspective view of the collar element of the inventive bib.

FIG. 3 is a closeup perspective view of the collar 12 element of the invention, the collar being shown here in an expanded state. Collar 12 has an inner border 29 adjacent neck opening 22. Hoop 14 is located adjacent the outer border 30 of collar 12 and collar 12 resides inside of hoop 14. It has been found that the encircling force of hoop 14 causes collar 12 to gather for a snug fit around a wearer's neck, without further help. The hoop 14, in its contracted state, causes the collar material to gather around neck opening 22 as evidenced by folds 32. However, it has been found that the addition of an elastic band 34 along inner border 29 by means well known in the garment arts provides an even better fit. The combination of the encircling force of hoop 14 and the elastic band 34 provide a fit which helps to prevent liquids and food materials from traveling down a wearer's neck and soiling the wearer's clothes. Provided that it is of an absorbent variety, the gathered material of the collar 12 around the neck opening 22 provides a large amount of gathered surface area to provide a high absorptive capacity to the wearer. Furthermore, the elastic aspect of collar allows a variety of varying neck sizes to be accommodated, within the confines of hoop.

Still referring to FIG. 3, the opposing arms 16 allow a large grasping surface at the top of the inventive bib 10 for purposes of pulling the ends of hoop 14 apart. The opposing arms 16 could be eliminated, such that only the fabric-covered hoop 14 would be available for grasping, but in the preferred embodiment, the opposing arms 16 are included. The opposing arms 16 are formed from upper extensions of the body 18 of the bib 10 and reside exterior to the hoop 14 and collar 12. The material of the body merely extends upward to form the opposing arms.

Figure 4:
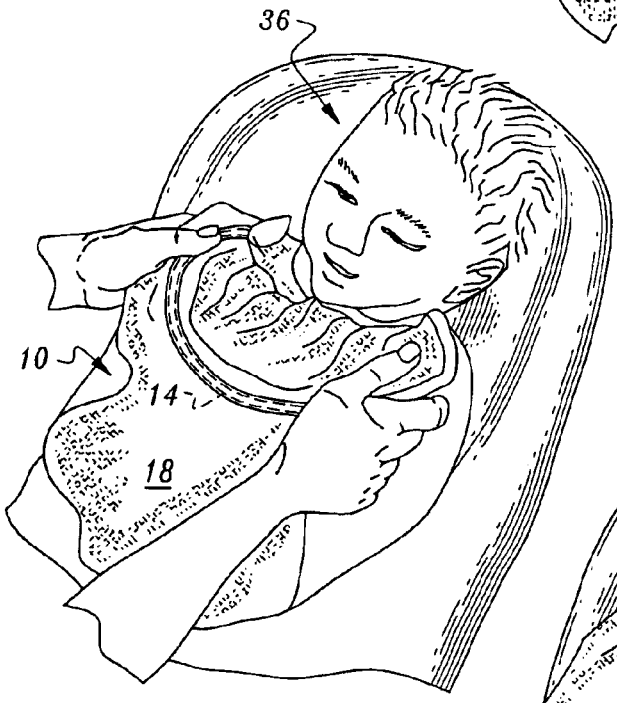
FIG. 4 is a front view of a sitting infant showing the inventive bib being expanded into proper position for placement upon the infant's neck.

FIG. 4 illustrates the inventive bib 10 being expanded into proper position for placement on an infant's neck. The bib 10 is placed by first grasping the opposing arms 16 and spreading them apart.

Figure 5:
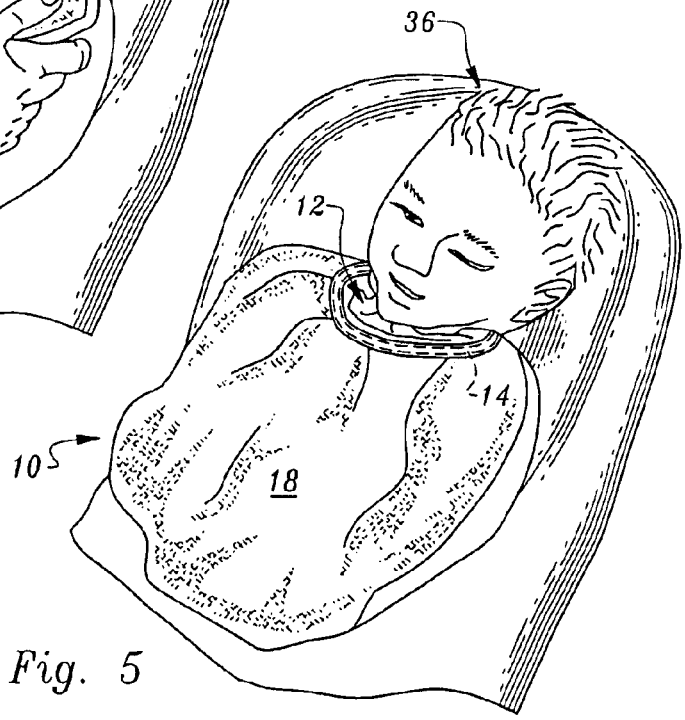
FIG. 5 is a front view of a sitting infant showing the inventive bib in place around the neck of the infant.

FIG. 5 shows the inventive bib 10 in place around the neck of an infant 36.

Figure 6:
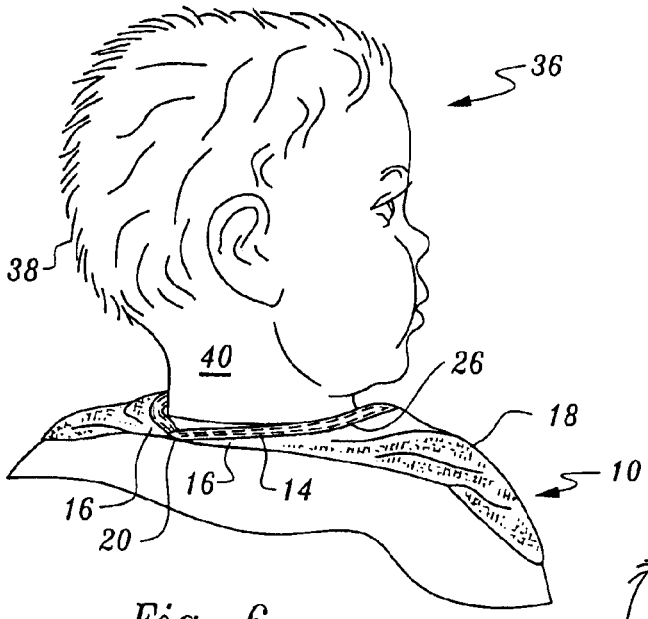
FIG. 6 is a rear closeup view of an infant's head showing the opposing arms being drawn together by the memory material of the hoop, around the back of the infant's neck and head.

FIG. 6 is a rear view of an infant's head 38 showing the opposing arms 16 being drawn together by the memory material of hoop, around the back of the infant's neck 40 and head 38. Here the ends 20 of hoop 14 are shown as overlapping. Also, the curved side sections 26 of hoop can be seen resting over the top of the infant's shoulders and directing the front body portion 18 of the inventive bib 10 over the chest of the infant 36.

Figure 7:
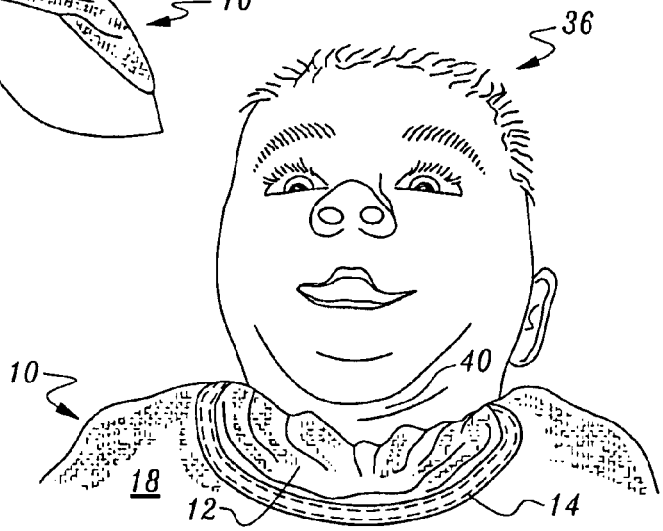
FIG. 7 is a closeup front view of an infant showing the inventive bib upon the neck of an infant. In this view the collar can clearly be seen gathered around the neck of the infant by the encircling force of the hoop.

FIG. 7 shows the inventive bib 10 fully placed upon the neck 40 of an infant 36. In this view collar 12 can clearly be seen gathered around the neck 40 of the infant 36 by the encircling force of hoop 14. As noted previously, but not clear in this view, an elastic band 34 placed around the inner border 29 of collar 12 further serves to enclose collar 12 around the neck 40 of the infant 36.

Figure 8:
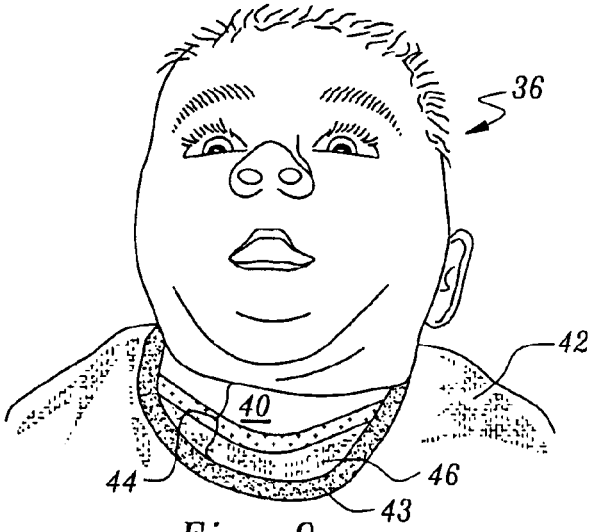
Fig. 8 (Prior Art)
FIG. 8 shows a prior art bib placed upon the neck of an infant for purposes of comparison with the inventive bib shown in the similar view of FIG. 7.

FIG. 8 shows a prior art bib 42 placed upon the neck 40 of an infant 36 for purposes of comparison with the inventive bib 10 in the similar view of FIG. 7. The lack of a snug fit of the prior art bib 42 is shown by the gap 44 between the infant's neck 40 and the inner border 43 of the bib 42. Also, the infant's clothes 46 are clearly unprotected. The inventive bib clearly eliminates these disadvantages in the prior art.

Finally, although the description above contains many specificities, these should not be construed as limiting the scope of the invention but as merely providing illustrations of some of the presently preferred embodiments of this invention. Other modifications are possible. For example, the inventive bib may be made to be either reusable or disposable. Also, the bib can be constructed in various sizes to fit the necks of differently sized wearers, such as for premature infants, full term infants, children and adults. Also, while the illustrations show the inventive bib being placed from the front of a wearer's neck, the invention could be modified by methods well known in the art to allow the bib to be placed from the side of the a wearer's neck. Furthermore, for added protection, a non-absorbent material may be inserted into the collar fabric to completely block liquid from saturating the collar and soiling a wearer's clothing. These and many other modifications by those skilled in this art are possible and are included within the scope of the appended claims.

What is claimed is:

1. A protective bib, comprising:

an expandable collar comprised of a gatherable material having an inner border and an outer border, said inner border forming a neck opening for encircling the neck of a human wearer, said outer border communicating with a flexible hoop, said collar being positioned inside of said flexible hoop such that said collar spans inward of said hoop toward said inner border to terminate at said neck opening, said hoop including a memory quality for allowing the expansion and contraction of said hoop and collar, and wherein upon being positioned upon a wearer's neck in a contracted state, said hoop is separated a distance from the wearer's neck by said collar now lying in a gathered fashion about the neck of the wearer, said inner border of said collar being tensioned snugly about the wearer's neck by said hoop, said hoop further comprising a preformed curved front section along said hoop's horizontal axis and a preformed side section curving rearward of said front section along said hoop's vertical axis, said front and side sections causing said hoop to lie fittingly about a wearer's shoulders and chest.

2. A protective bib, comprising:

an expandable collar comprised of a gatherable material having an inner border and an outer border, said inner border forming a neck opening for encircling the neck of a human wearer, said outer border communicating with a flexible hoop, said hoop terminating at two ends, said collar being positioned inside of said flexible hoop such that said collar spans inward of said hoop toward said inner border to terminate at said neck opening, said hoop including a memory quality for allowing the expansion and contraction of said hoop and collar, and wherein upon being positioned upon a wearer's neck in a contracted state, said hoop is separated a distance from the wearer's neck by said collar now lying in a gathered fashion about the neck of the wearer, said inner border of said collar being tensioned snugly about the wearer's neck by said hoop, said bib further comprising opposing arms, said opposing arms being exterior to said ends of said hoop, said opposing arms providing a grasping surface for spreading said hoop ends and arms apart.

3. A protective bib, comprising:

an expandable collar comprised of a gatherable material spanning between an outer border and an inner border of said collar, said collar further being positioned within an interior area of a flexible hoop, said hoop being formed to lie fittingly upon the shoulders and chest of a human wearer, said flexible hoop communicating with and substantially encircling said collar, said hoop including a memory quality for allowing the expansion and contraction of said collar about the neck of a wearer; and a body portion extending below said hoop and collar.

4. The protective bib as recited in claim 3, wherein said formably fitted flexible hoop further comprises a preformed curved front section along said hoop's horizontal axis and a preformed side section curving rearward of said front section along said hoop's vertical axis, said curved front and side sections causing said hoop to lie fittingly upon a wearer's shoulders and chest.

5. The protective bib as recited in claim 3, wherein said hoop terminates at two ends, said ends communicating with a pair of opposing arms located exterior to said ends, said opposing arms providing a grasping surface for spreading said hoop ends and arms apart.

6. The protective bib as recited in claim 3, wherein said hoop further comprises overlapping ends in its contracted state to bring said collar in snug contact with a wearer's neck.

7. The protective bib as recited in claim 3, wherein said collar further comprises a neck opening, said neck opening having an elastic material coupled along said neck opening creating an expandable region for elastically encircling the neck of a wearer.

8. The protective bib of claim 3, wherein said gatherable collar material is further comprised of absorbent material.

9. The protective bib of claim 3, wherein said gatherable collar material is further comprised of non-absorbent material.

* * * * *